US006374783B1

(12) United States Patent
Toriumi

(10) Patent No.: US 6,374,783 B1
(45) Date of Patent: Apr. 23, 2002

(54) METHOD AND APPARATUS FOR CONTROLLING AN ELECTROMAGNETICALLY OPERATED ENGINE VALVE TO INITIAL CONDITION BEFORE ENGINE STARTUP

(75) Inventor: Masaki Toriumi, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/635,685

(22) Filed: Aug. 10, 2000

(30) Foreign Application Priority Data

Aug. 10, 1999 (JP) ..... 11-226147

(51) Int. Cl.[7] ..... F01L 9/04

(52) U.S. Cl. ..... 123/90.11; 251/129.01; 251/129.1; 251/129.15; 251/129.16

(58) Field of Search ..... 123/90.11; 251/129.01, 251/129.1, 129.15, 129.16, 129.18

(56) References Cited

U.S. PATENT DOCUMENTS 4,544,986 A * 10/1985 Buchl ..... 361/152
4,614,170 A 9/1986 Pischinger et al. ..... 123/90.11
5,645,019 A 7/1997 Liang et al. ..... 123/90.11
5,730,091 A 3/1998 Diehl et al. ..... 123/90.11
6,186,100 B1 2/2001 Sawada ..... 123/90.11

OTHER PUBLICATIONS

Patent Abstracts of Japan, 09256825 A, Sep. 30, 1997.

* cited by examiner

*Primary Examiner*—Thomas Denion
*Assistant Examiner*—Jaime Corrigan
(74) *Attorney, Agent, or Firm*—Foley & Lardner

(57) ABSTRACT

An apparatus for controlling an electromagnetically operated engine valve to an initial condition before an engine startup is disclosed. The apparatus is adapted for determining a viscosity of an engine lubricating oil and executing either one of a resonant initialization, in which the engine valve is oscillated to be moved from a mid-open position to a closed or full open position and held therein by alternately energizing two electromagnets of an electromagnetic actuator, and a one-shot initialization, in which the engine valve is moved from the mid-open position to the closed or full open position and held therein with one stroke by onetime energizing one of the electromagnets, depending on the determined viscosity of an engine lubricating oil. A method for controlling the engine valve to the initial condition is also disclosed.

47 Claims, 12 Drawing Sheets

METHOD AND APPARATUS FOR CONTROLLING AN ELECTROMAGNETICALLY OPERATED ENGINE VALVE TO INITIAL CONDITION BEFORE ENGINE STARTUP

BACKGROUND OF THE INVENTION

1. Field of the Invention

The present invention relates to a method and apparatus for controlling an electromagnetically operated engine valve, in which the engine valve is brought into an initial condition in advance of an engine startup wherein the engine valve is held in one of a closed position and a full open position.

Such an electromagnetically operated engine valve, i.e., intake and exhaust valves, is biased by a pair of springs to be held in a mid-open position between the closed and full open positions. The engine valve is moved to the closed or full open position against the biasing force of the spring by an electromagnetic attraction. The attraction is generated upon energizing one of two electromagnets and applied to the engine valve via an armature associated with the engine valve. The engine valve is forced to an initialized condition in which the engine valve is placed and held in the closed or full open position, in advance of an engine startup. This is referred to as an initialization control of the engine valve. After that, in the case of actuating the engine valve in the opening direction, the valve-closing electromagnet is de-energized to move the engine valve into the opening direction by the biasing force of the valve-opening spring. When the engine valve is moved closer to the valve-opening electromagnet, the valve-opening electromagnet is energized to attract the engine valve. The engine valve then is moved to and held in the full open position by the attraction of the valve-opening electromagnet. On the other hand, in the case of actuating the engine valve in the closing direction, the valve-opening electromagnet is de-energized to permit the engine valve to move in the closing direction and approach the valve-closing electromagnet. The valve-closing electromagnet is then energized to attract and hold the engine valve in the closed position.

The initialization control of the engine valve may be conducted in such a simple manner as to onetime energize the valve-opening or valve-closing electromagnet to thereby move the engine valve from the mid-open position to the closed or full open position with one stroke. However, in the simple initialization control, a stroke of the engine valve is relatively large. This causes an increased power consumption.

U.S. Pat. No. 4,614,170 attempts to reduce a power consumption by oscillating an engine valve with an increased amplitude using resonance phenomena of a spring/mass which occurs upon alternately energizing valve-opening and valve-closing electromagnets. As a result, the valve is placed and held in one of the closed and full open positions.

SUMMARY OF THE INVENTION

However, in the latter conventional technique, upon the initialization control at a low temperature, a lubricating oil with an increased viscosity tends to increase friction, causing a power consumption greater than that in the former conventional technique. This will also cause an increased power consumption of a vehicular battery before completion of the initialization, leading to failure of the initialization of the engine valve.

The present invention contemplates to eliminate the above-described disadvantages of the conventional techniques. Specifically, it is an object of the present invention to provide a method and apparatus for controlling an electromagnetically operated engine valve, in which an improved initialization control of the engine valve is conducted.

According to one aspect of the present invention, there is provided an apparatus for controlling an engine valve operated by an electromagnetic actuator, the engine valve having a closed position and a full open position, the electromagnetic actuator including springs cooperating to bias the engine valve toward a mid-open position between the closed and full open positions and two electromagnets attracting and moving the engine valve in the closed and full open positions against spring forces of the springs upon being energized, respectively, the apparatus comprising:

sensor means for sensing a parameter to be used in determining a viscosity of an engine lubricating oil; and a controller programmed to determine the viscosity of an engine lubricating oil on the basis of the parameter sensed and execute either one of a resonant initialization preceding an engine startup, in which the engine valve is oscillated with an increasing amplitude to be moved from the mid-open position to one of the closed and full open positions and held therein by alternate energization of the electromagnets, and a one-shot initialization preceding the engine startup, in which the engine valve is moved from the mid-open position to one of the closed and full open positions and held therein with one stroke by onetime energization of one of the electromagnets, depending on the determined viscosity of an engine lubricating oil.

According to a further aspect of the present invention, there is provided an apparatus for controlling an engine valve operated by an electromagnetic actuator, the engine valve having a closed position and a full open position, the electromagnetic actuator including springs cooperating to bias the engine valve toward a mid-open position between the closed and full open positions and two electromagnets attracting and moving the engine valve in the closed and full open positions against spring forces of the springs upon being energized, respectively, the apparatus comprising:

a sensor detecting a parameter to be used in determining a viscosity of an engine lubricating oil and generating a signal indicative of the parameter detected; and a controller, in response to the signal generated from the sensor, determining the viscosity of an engine lubricating oil, the controller selecting either one of a resonant initialization preceding an engine startup, in which the engine valve is oscillated with an increasing amplitude to be moved from the mid-open position to one of the closed and full open positions and held therein, and a one-shot initialization preceding the engine startup, in which the engine valve is moved from the mid-open position to one of the closed and full open positions and held therein with one stroke, depending on the determined viscosity of the engine lubricating oil, and the controller developing a first control command for alternately energizing the electromagnets for the resonant initialization and a second control command for one-time energizing one of the electromagnets for the one-shot initialization.

According to a still further aspect of the present invention, there is provided a method of controlling an engine valve operated by an electromagnetic actuator, the engine valve having a closed position and a full open position, the electromagnetic actuator including springs cooperating to bias the engine valve toward a mid-open position between the closed and full open positions and two electromagnets attracting and moving the engine valve in the closed and full open positions against spring forces of the springs upon being energized, respectively, the method comprising:

determining a viscosity of an engine lubricating oil;

selecting either one of a resonant initialization preceding an engine startup, in which the engine valve is oscillated with an increasing amplitude to be moved from the mid-open position to one of the closed and full open positions and held therein by alternately energizing the electromagnets, and a one-shot initialization preceding the engine startup, in which the engine valve is moved from the mid-open position to one of the closed and full open positions and held therein with one stroke by onetime energizing one of the electromagnets, depending on the determined viscosity of an engine lubricating oil; and executing the selected one of the resonant initialization and the one-shot initialization.

DESCRIPTION OF THE PREFERRED EMBODIMENT

Figure 2A:
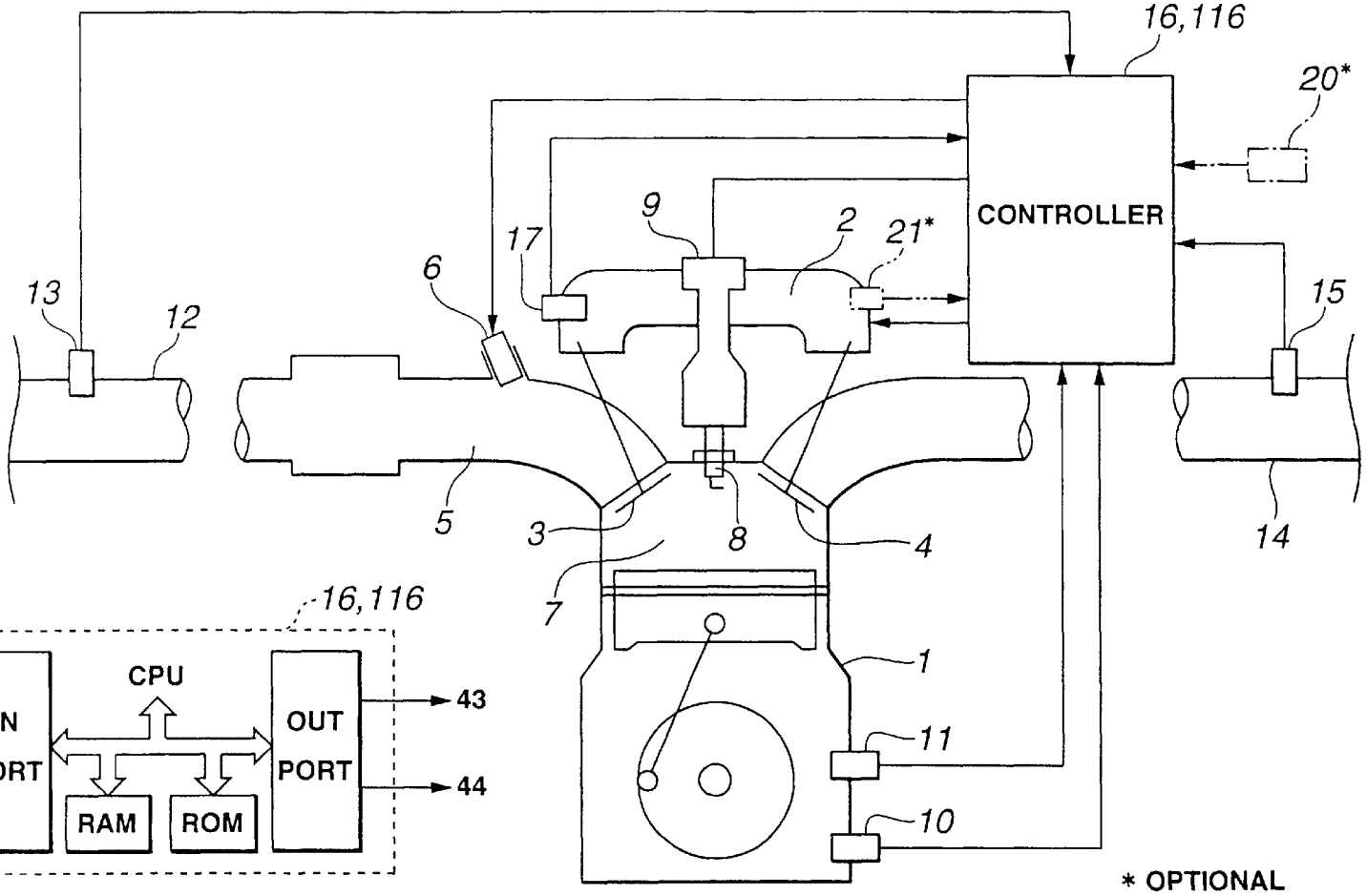
FIG. 2A is a schematic diagram of an engine system in which the principles of the present invention are carried out in accordance with the embodiments.
Figure 2B:
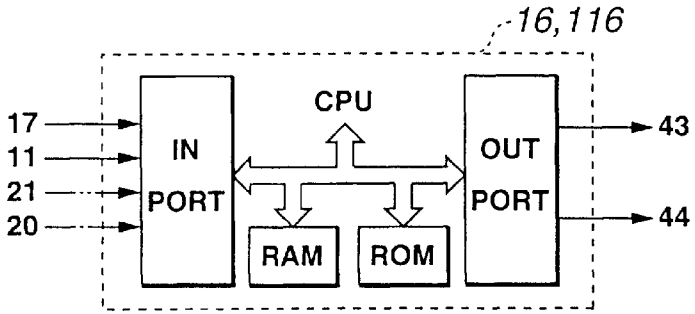
FIG. 2B illustrates a block diagram of a controller.

Referring now to FIG. 2A, there is shown an engine system including an engine 1 having an intake valve 3 and an exhaust valve 4. Intake and exhaust valves 3 and 4 are electronically operated by a valve actuator 2. A fuel injector valve 6 is mounted to an intake port 5 of each of engine cylinders of engine 1. An ignition plug 8 and an ignition coil 9 actuating ignition plug 8 are mounted to a combustion chamber 7. A crank angle sensor 10 is mounted to engine 1, which detects a reference crank angle of each engine cylinder and a fine crank angle and generates a reference angle signal indicative of the reference crank angle and a unit angle signal indicative of the fine crank angle. A coolant temperature sensor 11 is mounted to engine 1, which detects a temperature of an engine coolant and generating a signal Tw indicative of the temperature detected. An airflow meter 13 detecting an amount of intake air is disposed upstream of an intake pipe 12. An air-fuel ratio sensor 15 is mounted to an exhaust pipe 14, which detects an air-fuel ratio, for instance, on the basis of detection results of oxygen concentration in the exhaust gas passing through exhaust pipe 14. These sensors are connected to a controller 16. Controller 16 may be formed by a microcomputer, for example, including a central processing unit (CPU), input ports (IN PORT), output ports (OUT PORT), read-only memory (ROM), random access memory (RAM) and a common data bus as shown in FIG. 2B. Controller 16 receives the signals generated from the sensors, processes the signals, and develops a fuel injection control command outputted to fuel injector valve 6 for controlling the fuel injection and an ignition control command outputted to ignition coil 9 for controlling the ignition timing. Controller 16 also develops an actuator control command for operating valve actuator 2 so as to open and close the engine valve, i.e., each of intake and exhaust valves 3 and 4. An oil temperature sensor 17 is also connected to controller 16. Oil temperature sensor 17 detects a temperature of an engine lubricating oil and generates a signal To indicative of the temperature detected. An oil pressure sensor 20 and a lift sensor 21 are optionally provided and connected to controller 16. Oil pressure sensor 20 detects a pressure of the engine lubricating oil and generates a signal Po indicative of the pressure detected. Lift sensor 21 detects a lift amount of the engine valve and generates a signal indicative of the lift amount detected. In other words, lift sensor 21 detects an amount of displacement of an armature 42 of valve actuator 2 as explained later, and generates a signal indicative of the displacement amount detected. Lift sensor 21 may be in the form of a laser distance meter. Controller 16 receives and processes the signals from sensors 17, 11 and 20 to determine a viscosity of an engine lubricating oil and, depending on the determined viscosity thereof, develops an initialization control command for operating valve actuator 2 so as to drive the engine valve to one of a closed position and a full open position in advance of the engine startup. This engine valve initialization control will be explained in detail later.

Figure 3:
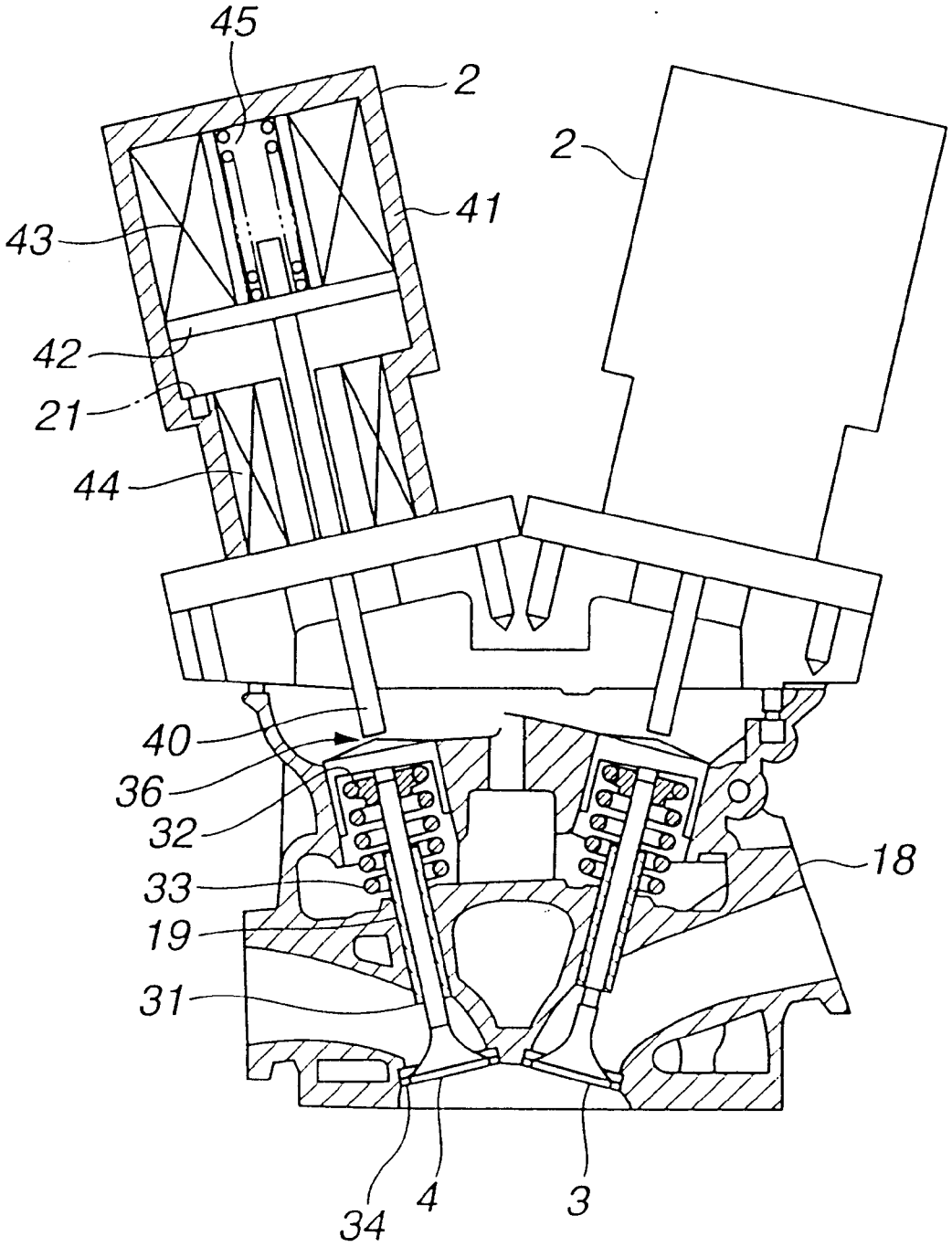
FIG. 3 is a partially sectional view of an arrangement of intake and exhaust valves and a valve actuator therefor in the preferred embodiments, showing the intake and exhaust valves in the closed positions.

Referring to FIG. 3, the arrangement of intake and exhaust valves 3 and 4 and valve actuator 2 therefor is described.

As illustrated in FIG. 3, exhaust valve 4 is mounted to a cylinder head 18 in the same manner as the conventional ones. Exhaust valve 4 includes a stem 31 slidably received in a valve guide 19 disposed within cylinder head 18. A valve-closing spring 33 biasing exhaust valve 4 in a closing direction is installed between an upper seat 32 attached to an upper end of stem 31 through a valve cotter, not shown, and a lower seat provided on cylinder head 18. Spring 33 is in the form of a compression coiled spring. A valve seat 34 is fixed to a lower portion of cylinder head 18 which defines a part of combustion chamber 7. In FIG. 3, exhaust valve 4 is placed in the closed position in which exhaust valve 4 is in contact with valve seat 34. Exhaust valve 4 is prevented from the contact with valve seat 34 at the full open position and a mid-open position between the closed and full open positions.

Valve actuator 2 includes a housing 41 made of a non-magnetic material and a moveable shaft 40 disposed within housing 41 so as to be moveable in a direction of a center axis thereof. Shaft 40 is arranged in coaxial with stem 31 of exhaust valve 4 and has a lower portion projecting from housing 41 toward stem 31. Armature 42 is integrally formed with shaft 40 for a unitary axial motion therewith. A valve-closing electromagnet 43 and a valve-opening electromagnet 44 are fixedly disposed within housing 41 and spaced from each other in the axial direction of shaft 40. Valve-closing and valve-opening electromagnets 43 and 44 are spaced from and opposed to an upper surface and a lower surface of armature 42, respectively. Each of valve-closing and valve-opening electromagnets 43 and 44 includes a coil and is so constructed as to produce a magnetic attraction that is applied to armature 42, upon being energized, namely, when the coil is activated with an electrical current. Meanwhile, under condition that armature 42 is attracted by energized valve-closing magnet 43 and exhaust valve 4 is placed in the closed position, there is generated a space 36 as a valve clearance between a lower end of shaft 40 and the upper end of stem 31. A valve-opening spring 45 is disposed between an upper bottom of housing 41 and the upper surface of armature 42. Valve-opening spring 45 biases armature 42 toward valve-opening electromagnet 44, namely, in such a direction that shaft 40 urges exhaust valve 4 to move toward the full open position. Valve-opening spring 45 cooperates with valve-closing spring 33 to hold exhaust valve 4 in the mid-open position shown in FIG. 4 via armature 42.

Figure 4:
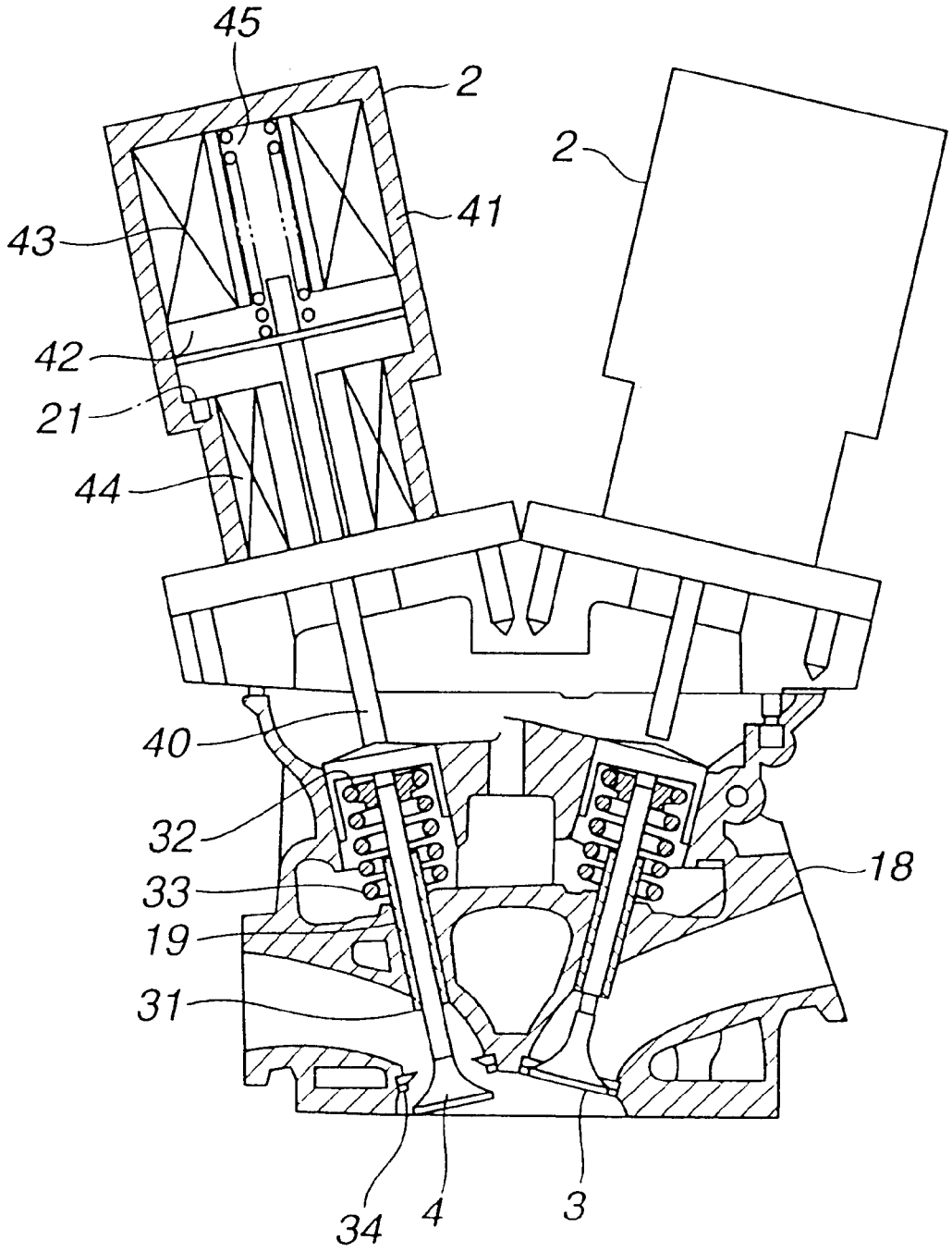
FIG. 4 is a view similar to FIG. 3, but showing the exhaust valve in the mid-open position.

When valve-closing electromagnet 43 and valve-opening electromagnet 44 are de-energized, exhaust valve 4 is held in the mid-open position shown in FIG. 4 by the biasing forces of springs 33 and 45. When only valve-closing electromagnet 43 is energized, exhaust valve 4 is moved from the mid-open position toward the closed position shown in FIG. 3 against the biasing force of valve-opening spring 45 owing to the magnetic attraction applied to armature 42. On the other hand, when only valve-opening electromagnet 44 is energized, exhaust valve 4 is moved from the mid-open position toward the full open position against the biasing force of valve-closing spring 33 by the magnetic attraction applied to armature 42.

Intake valve 3 is constructed and actuated in the same manner as that of exhaust valve 4.

The thus-constructed and operated engine valve, i.e., at least one of intake and exhaust valves 3 and 4, is moved from the mid-open position to one of the closed and full open positions and held therein on standby by the initialization control preceding the engine startup. The initialization control includes shifting between a resonant initialization in which the engine valve is oscillated with an increasing amplitude to be moved from the mid-open position to one of the closed and full open positions and held therein by alternate energization of electromagnets 43 and 44 and a one-shot initialization in which the engine valve is moved from the mid-open position to one of the closed and full open positions and held therein with one stroke by onetime energization of one of electromagnets 43 and 44.

Figure 1:
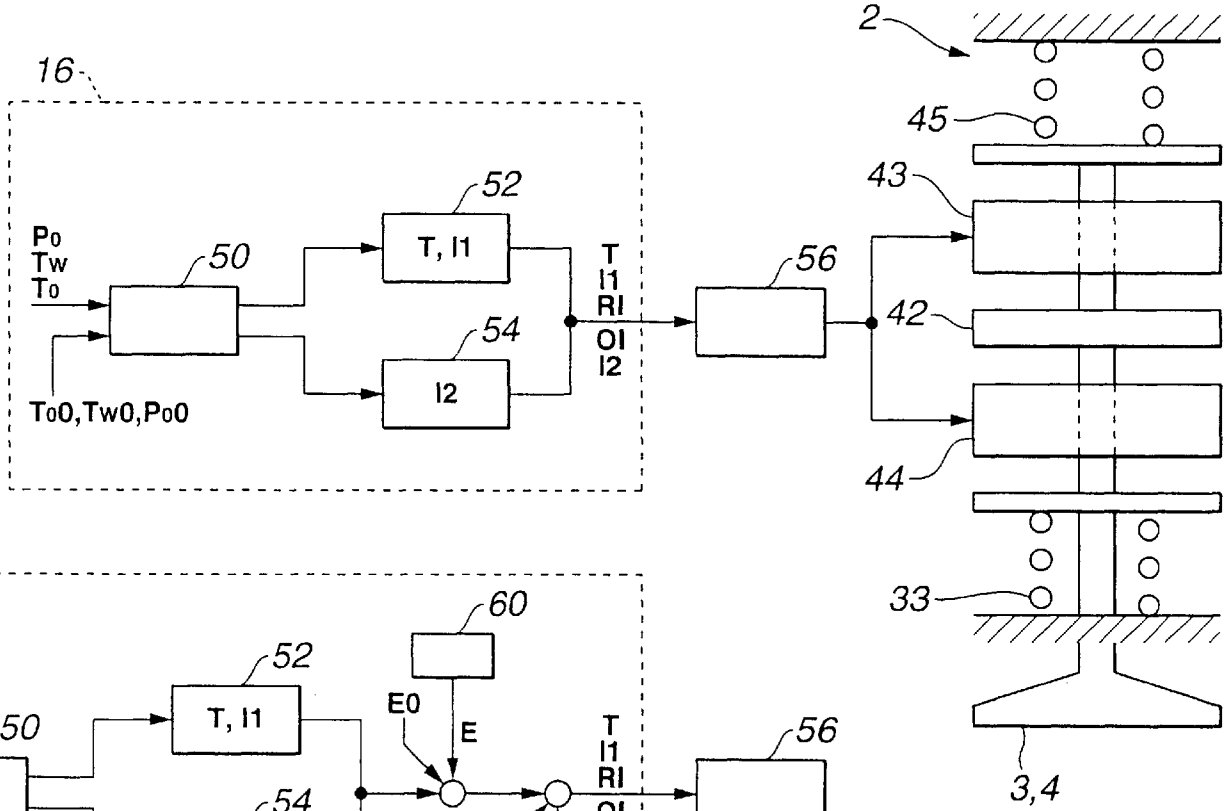
FIG. 1 illustrates a functional block diagram of a control system for implementing first to third embodiments of the present invention, with a schematic view of an electromagnetically operated engine valve.

Referring to FIG. 1, the initialization control carried out by controller 16 in the first through third embodiments of the present invention is explained.

Controller 16, at a section 50, determines a viscosity of the engine lubricating oil in response to the signals To, Tw and Po, as parameters, from sensors 17, 11 and 20. Controller 16 compares signals To, Tw and Po with predetermined values To0, Tw0 and Po0, as references, at section 50. In the first embodiment, controller 16 determines the engine lubricating oil viscosity by comparing the signal To indicative of an engine lubricating oil temperature with the predetermined value To0. Since the temperature of the engine lubricating oil has an intimate relationship with the viscosity thereof, the viscosity can be estimated on the basis of the detected temperature To. The predetermined value To0 of the engine lubricating oil temperature must be a lower limit value, for example, approximately 0° C., at which the engine lubricating oil has a maximum viscosity beyond which the engine valve will be influenced by an excessively high operating friction. Accordingly, assuming that the lubricating oil temperature To is below the predetermined value To0, the lubricating oil viscosity will be large enough to cause the excessively high operating friction of the engine valve. This will cause an increased power consumption if the resonant initialization is carried out, as compared with a power consumption caused by the one-shot initialization.

In the second embodiment, controller 16 determines the engine lubricating oil viscosity by comparing the signal Tw indicative of an engine coolant temperature with the predetermined value Tw0. The temperature of the engine coolant is in proportion to the engine lubricating oil temperature, whereby a viscosity of the engine lubricating oil can be estimated on the basis of the detected engine coolant temperature Tw. Although the determination of the viscosity based on the engine coolant temperature is inferior in accuracy to the determination thereof based on the engine lubricating oil temperature, it can contribute to cost-saving because the coolant temperature sensor is generally utilized in various engine controls. The predetermined value Tw0 of the engine coolant temperature must be a temperature at which the engine lubricating oil temperature is considered to reach the predetermined value To0. The predetermined value Tw0 may be approximately 0° C.

In the third embodiment, controller 16 determines the engine lubricating oil viscosity by comparing the signal Po indicative of an engine lubricating oil pressure with the predetermined value Po0. The pressure of the engine lubricating oil is in proportion to the viscosity thereof. Therefore, the engine lubricating oil viscosity can be estimated on the basis of the detected oil pressure Po. The oil pressure-based determination of the engine lubricating oil viscosity will be at an intermediate level in accuracy between levels of the oil temperature-based determination and the coolant temperature-based determination. The viscosity determination using the oil pressure sensor is advantageous in such a case where the oil pressure sensor is installed in the vehicle for use in other controls or if there is a problem in layout of the oil temperature sensor. The predetermined value Po0 of the engine lubricating oil pressure must be an upper limit value at which the engine lubricating oil has a maximum viscosity beyond which the engine valve will suffer from an excessively high operating friction.

Controller 16 selects either one of the resonant initialization and the one-shot initialization depending on the determined viscosity of the engine lubricating oil at section 50. When the resonant initialization is selected, controller 16, at a section 52, determines a period T of energization of each electromagnet 43 and 44 and an electrical current value I1 supplied to the coil thereof. The energization period T and the current value I1 are determined at appropriate values on the basis of the determined viscosity of the engine lubricating oil. The energization period T may be a generally constant value of a natural-oscillating period of a spring-mass system including the engine valve, the valve actuator 2 and the springs 33 and 45. For instance, the energization period T may be 7 milliseconds (msec). The current value I1 may be a relatively large value because the operating friction of the engine valve increases if the engine lubricating oil has a lower temperature and a larger viscosity. On the other hand, when the one-shot initialization is selected, controller 16, at a section 54, determines an electrical current value I2 supplied to the coil of the one of electromagnets 43 and 44 which is to be energized. The current value I2 is larger than the current value I1. The current value I2 is determined at an appropriate value on the basis of the viscosity of the lubricating oil. The current value I2 also may be a relatively large value by the same reason as that described above about the current I1. In order to assure that the engine valve is placed in the one of the closed and full open positions in the one-shot initialization, the current value I2 may be a maximum value irrespective of the lubricating oil viscosity determined based on the detected lubricating oil temperature To. Controller 16 develops the energization period control command T, the current control command I1 and a control command RI outputted to an actuator 56 for starting the resonant initialization. Controller 16 develops the current control command I2 and a control command OI outputted to actuator 56 for starting the one-shot initialization. It will be appreciated from the above description that controller 16 and each section 50, 52 and 54 included therein would typically be implemented in software on a computer, but hardware and/or firmware implementations are also contemplated.

Figure 5:
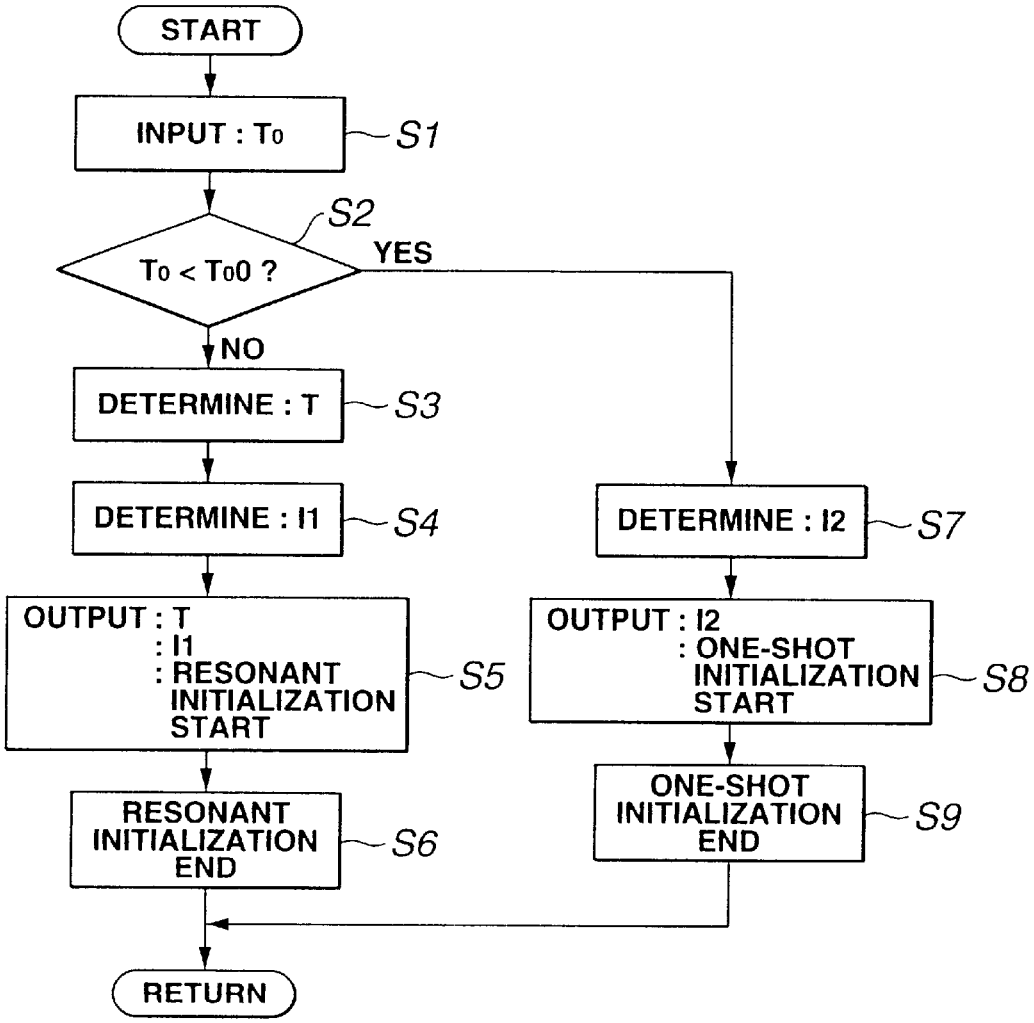
FIG. 5 is a flow diagram for implementing the first embodiment of the present invention.

Referring to FIG. 5, a flow of the initialization control implemented in the first embodiment will be explained hereinafter.

Logic flow starts and goes to block S1 where the engine lubricating oil temperature To detected by oil temperature sensor 17 is inputted. At decision block S2, an interrogation is made whether or not the detected temperature To is smaller than the predetermined value To0. If the interrogation at decision block S2 is in negative, indicating that the detected temperature To is not less than the predetermined value To0, it is decided to execute a routine of the resonant initialization control and the logic flow goes to block S3. The routine of the resonant initialization control is executed at blocks S3–S6. At block S3, the period T of energization of each electromagnet 43 and 44 upon the resonant initialization is determined. At block S4, the current value I1 supplied to the coil of each electromagnet 43 and 44 is determined. At block S5, the determined period T and the determined current value I1 are outputted and the resonant initialization is commenced. At block S6, the number of alternate energization of electromagnets 43 and 44 is counted and the resonant initialization is terminated when the counted number thereof becomes equal to a predetermined value. Otherwise, the resonant initialization may be terminated when a predetermined time elapses from the commencement of the resonant initialization.

Figure 6:
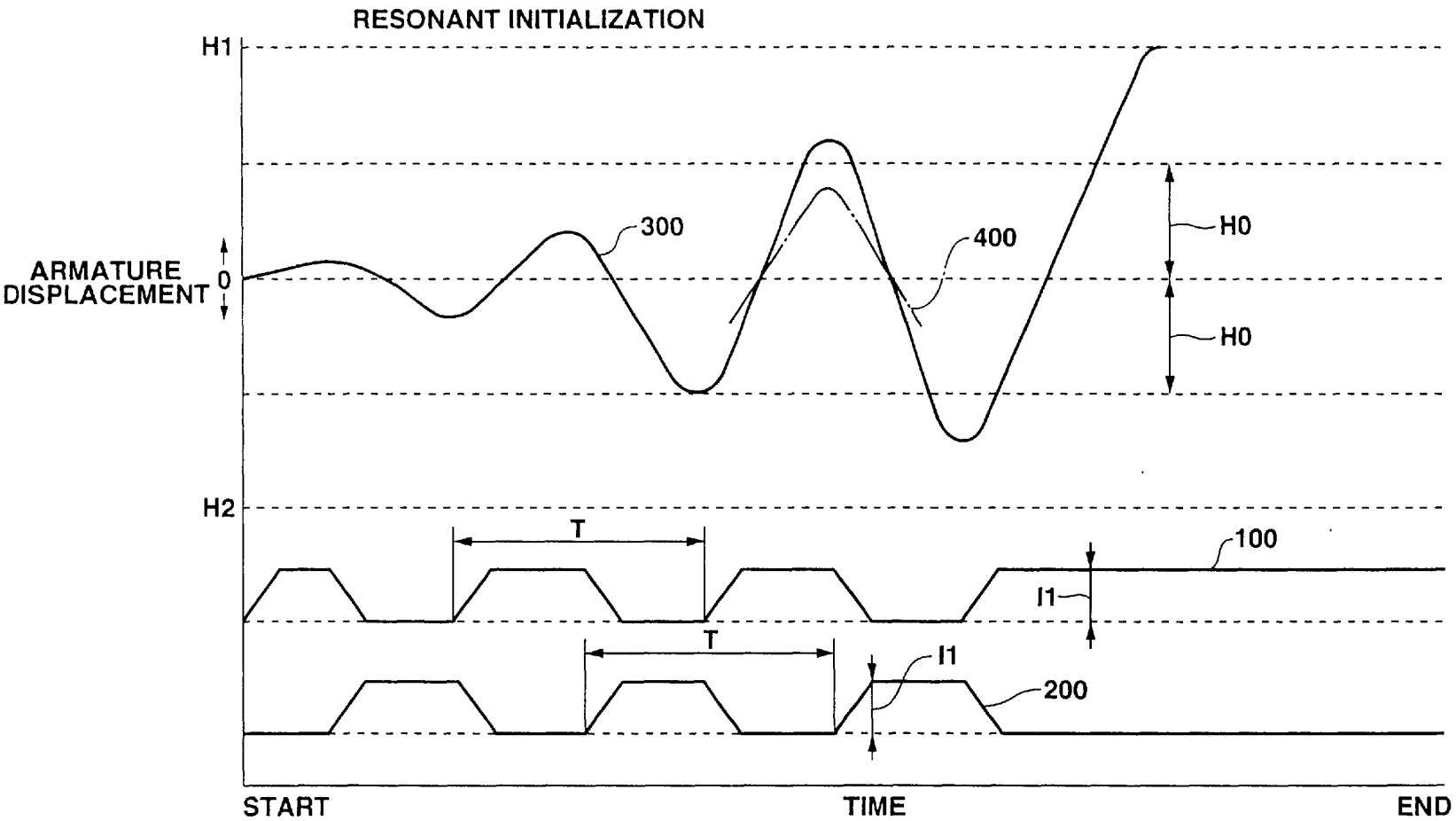
FIG. 6 is a timing chart for a resonant initialization control of the intake and exhaust valves.

FIG. 6 shows the alternate energization of electromagnets 43 and 44 and the displacement of armature 42 and the engine valve associated therewith, as a function of time, upon the resonant initialization. Lines 100 and 200 illustrate the currents flowing through the coils of electromagnets 43 and 44, respectively, when electromagnets 43 and 44 are alternately energized. Curve 300 illustrates variation in displacement of armature 42.

Referring back to FIG. 5, if the interrogation at decision block S2 is in affirmative, indicating that the detected temperature To is smaller than the predetermined value To0, it is decided to execute a routine of the one-shot initialization control and the logic flow goes to block S7. The routine of the one-shot initialization control is executed at blocks S7–S9. At block S7, the current value I2 supplied to the coil of one of electromagnets 43 and 44 which is to be energized, is determined. At block S8, the determined current value I2 is outputted and the one-shot initialization is commenced. At block S9, the one-shot initialization is terminated when a predetermined time elapses from the commencement of the one-shot initialization. The predetermined time may be not less than five times the natural oscillating period of the spring-mass system, for instance, 35 msec or more. Alternatively, if lift sensor 21 is used, the one-shot initialization may be terminated when it is determined that armature 42 is attracted to the energized one of electromagnets 43 and 44 on the basis of the lift amount detected by lift sensor 21.

Figure 7:
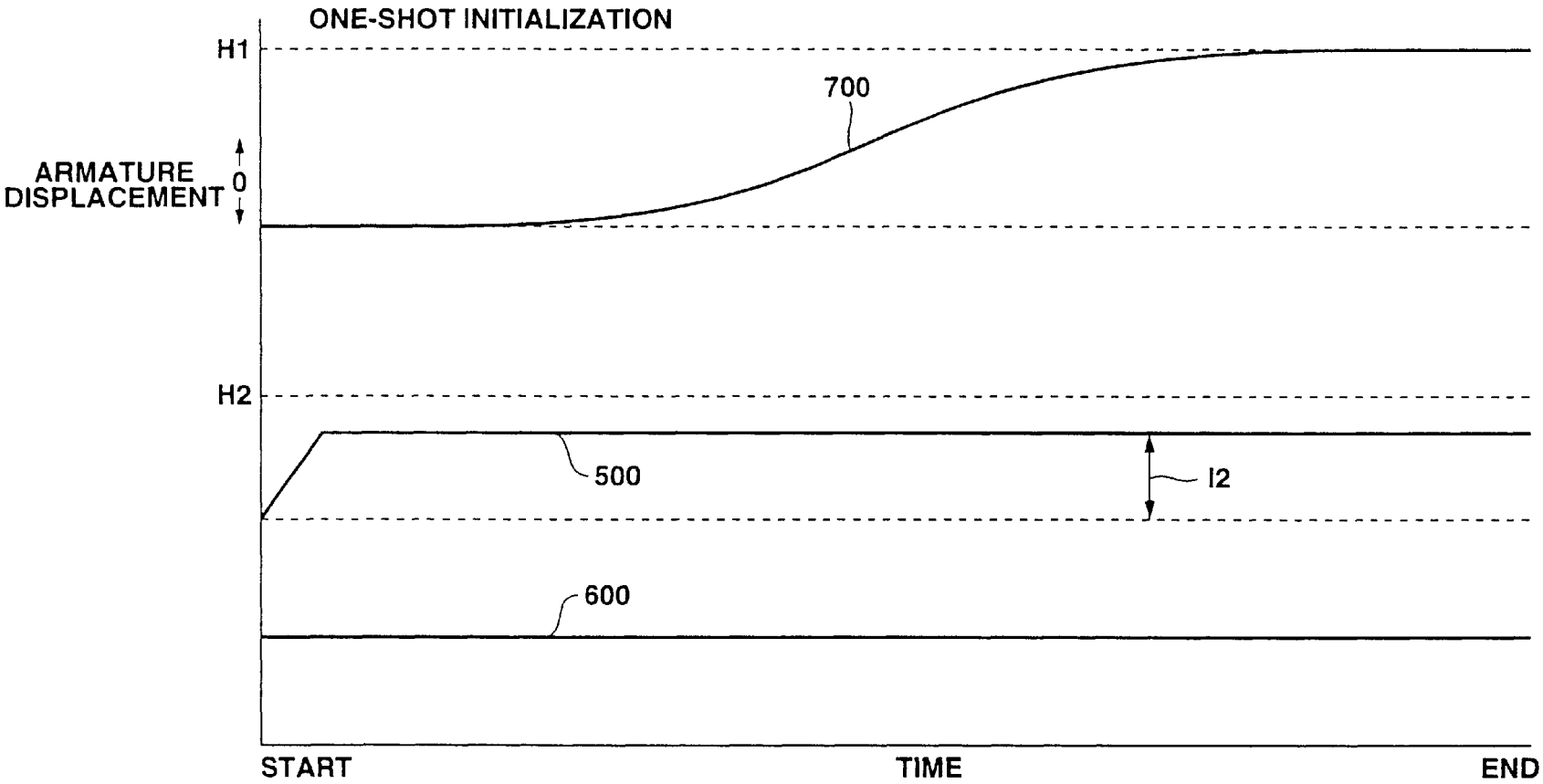
FIG. 7 is a timing chart for a one-shot initialization control of the intake and exhaust valves.

FIG. 7 shows the onetime energization of one of electromagnets 43 and 44 and the displacement of armature 42 and the engine valve associated therewith, as a function of time, upon the one-shot initialization. Line 500 illustrates the current in the coil of electromagnet 43 energized. Line 600 illustrates the current in the coil of electromagnet 44 de-energized. Curve 700 illustrates variation in displacement of armature 42.

As be appreciated from the above explanation of the first embodiment of the invention, either one of the resonant initialization and the one-shot initialization is selected depending on the viscosity of the engine lubricating oil. While the resonant initialization is carried out when the engine is started during a normal condition wherein the viscosity of the engine lubricating oil is not so large, the one-shot initialization is conducted when the engine is started during a cold condition wherein the viscosity of the engine lubricating oil is considerably large. By the initialization control of the first embodiment, the one of the resonant initialization and the one-shot initialization whichever provides a lower power consumption can be always selected and executed. This can serve for saving the power consumption. Further, in the first embodiment, the determination of the viscosity of the engine lubricating oil is conducted on the basis of the detection results of the lubricating oil temperature intimately relevant to the viscosity. Therefore, the engine lubricating oil viscosity can be determined with high accuracy and the decision based on the determined viscosity, in selection of the power-saving one of the two initializations, can be carried out with an increased accuracy.

Figure 8:
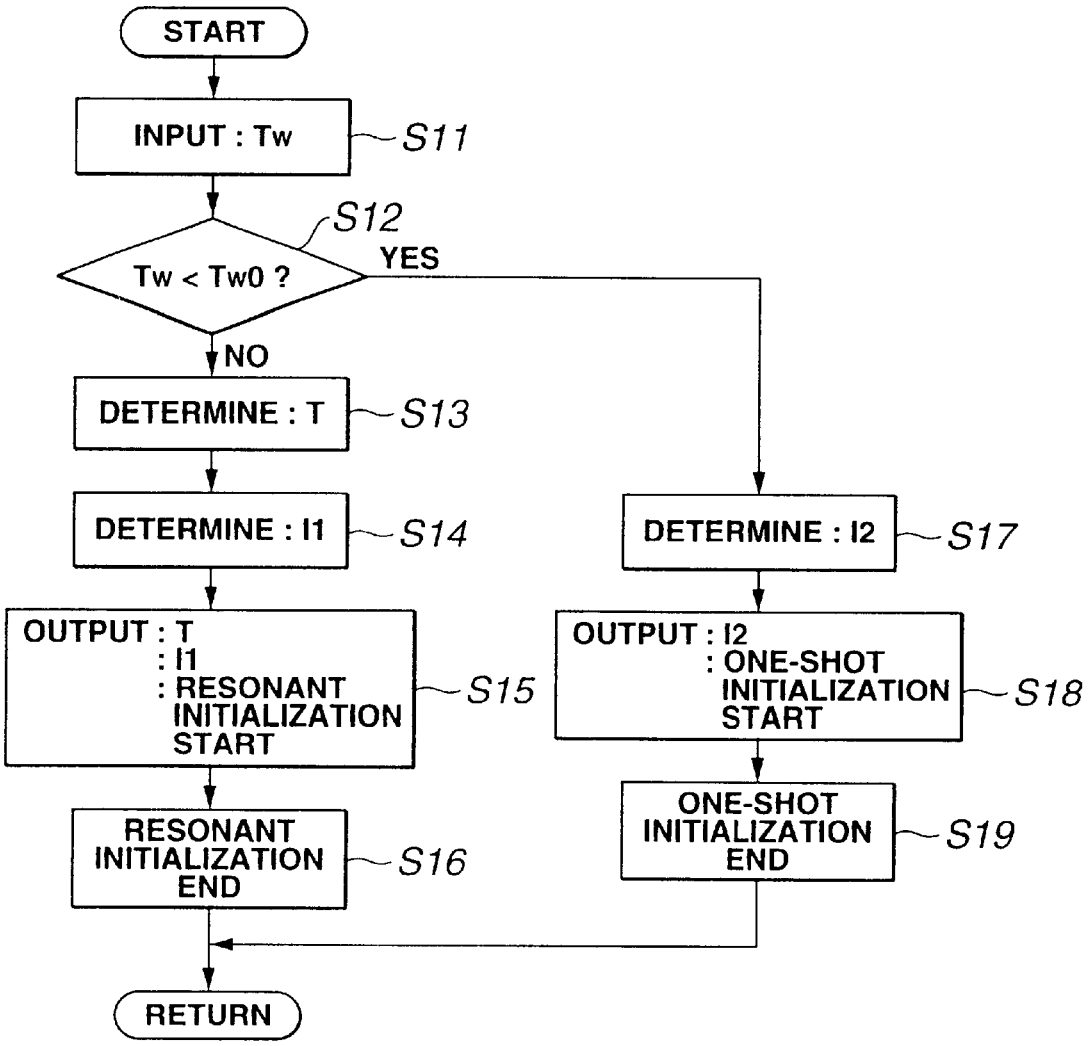
FIG. 8 is a flow diagram for implementing the second embodiment of the present invention.

Referring to FIG. 8, a flow of the initialization control implemented in the second embodiment is explained. The flow is similar to the first embodiment except that a temperature of an engine coolant is used in determination of the viscosity of the engine lubricating oil. At block S11, the engine coolant temperature Tw detected by coolant temperature sensor 11 is inputted. At decision block S12, an interrogation is made whether or not the detected temperature Tw is smaller than the predetermined value Tw0. If the interrogation at decision block S12 is in negative, indicating that the detected temperature Tw is not less than the predetermined value Tw0, it is decided to execute a routine of the resonant initialization control and the logic flow goes to blocks S13–S16 at which a sequence of operations of the resonant initialization is carried out. If the interrogation at decision block S12 is in affirmative, indicating that the detected temperature Tw is smaller than the predetermined value Tw0, it is decided to execute a routine of the one-shot initialization control and the logic flow goes to blocks S17–S19 at which a sequence of operations of the one-shot initialization is conducted.

Figure 9:
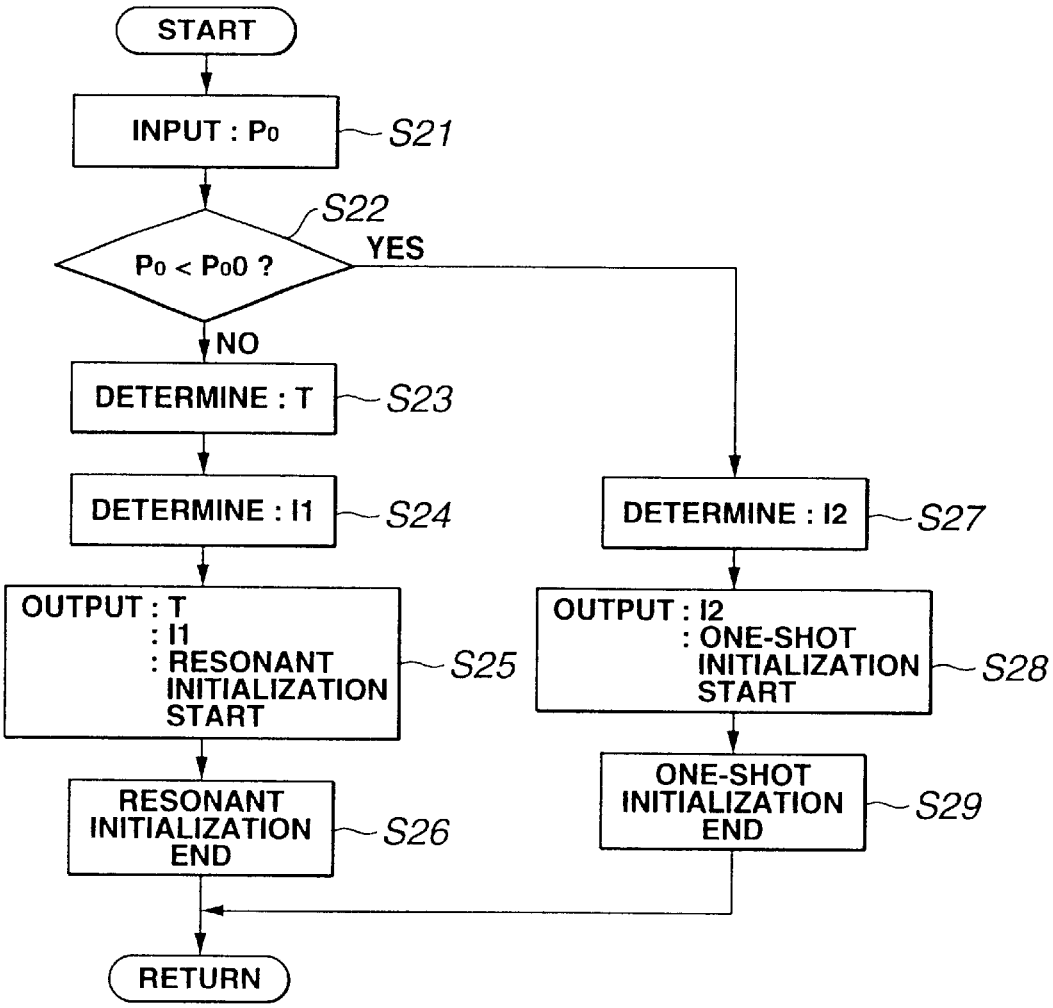
FIG. 9 is a flow diagram for implementing the third embodiment of the present invention.

FIG. 9 shows a flow of the initialization control implemented in the third embodiment, which differs from the first embodiment in using a pressure of an engine lubricating oil in determination of the viscosity of the engine lubricating oil. At block S21, the engine lubricating oil pressure Po detected by oil pressure sensor 20 is inputted. At decision block S22, an interrogation is made whether or not the detected pressure Po is smaller than the predetermined value Po0. If the interrogation at decision block S22 is in negative, indicating that the detected pressure Po is not less than the predetermined value Po0, it is decided to execute a routine of the resonant initialization control and the logic flow goes to blocks S23–S26 at which a sequence of operations of the resonant initialization is carried out. If the interrogation at decision block S22 is in affirmative, indicating that the detected pressure Po is smaller than the predetermined value Po0, it is decided to execute a routine of the one-shot initialization control and the logic flow goes to blocks S27–S29 at which a sequence of operations of the one-shot initialization is conducted.

Figure 10:
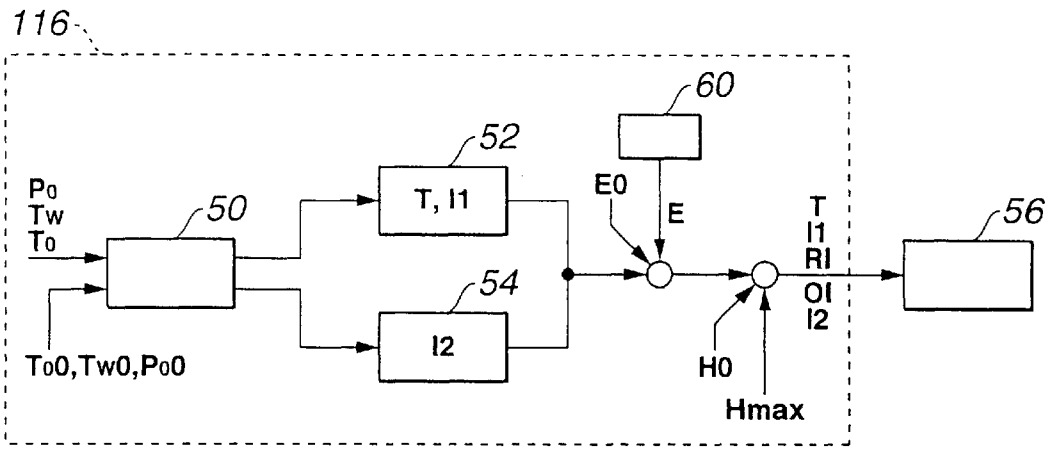
FIG. 10 is a functional block diagram similar to FIG. 1, but showing the control system for implementing the fourth to sixth embodiments of the present invention.

Referring to FIG. 10, the initialization control carried out by a controller 116 in the fourth through sixth embodiments of the invention, is explained. Although, for simple illustration, only controller 116 is shown in FIG. 10, it will be noted that controller 116 is connected with electromagnetic valve actuator 2 similar to controller 16 shown in FIG. 1. In FIG. 10, controller 116 executes at sections 50, 52 and 54 the same operations as those executed by controller 16. Controller 116 measures an elapsed time E from the start of the resonant initialization at a section 60 and determines that the measured time E reaches a predetermined time E0. The predetermined time E0 may be set to, for instance, approximately ten times a resonant period of the engine valve which is determined based on a mass of the moveable portions including the engine valve and valve actuator 2 as well as a spring constant of springs 33 and 45. If the resonant period is approximately 7 msec, the predetermined time E0 will be approximately 70 msec. Controller 116 determines a maximum amount Hmax of displacement of armature 42, i.e., a maximum amount Hmax of the engine valve lift, in response to a signal from lift sensor 21, and compares the maximum amount Hmax with a predetermined value H0. The predetermined value H0 is a lower limit value required for normally executing the resonant initialization during the predetermined time E0. Namely, if the maximum amount Hmax does not reach the predetermined value H0 during the predetermined time E0, it can be determined that the resonant initialization is not normally carried out. The predetermined value H0 may be approximately a half of a distance between the neutral displacement position of armature 42 corresponding to the mid-open position of the engine valve and each of the maximum displacement positions of armature 42 corresponding to the closed and full open positions of the engine valve. As illustrated in FIG. 6, the displacement amount of armature 42 is zero at the neutral displacement position and H1 and H2 at the maximum displacement positions. Controller 116 makes a changeover from the resonant initialization to the one-shot initialization when the measured time E is not less than the predetermined time E0 and the detected maximum amount Hmax is smaller than the predetermined value H0. Controller 116 then develops the current control command I2 and the control command OI outputted to actuator 56 for starting the one-shot initialization.

Figure 11:
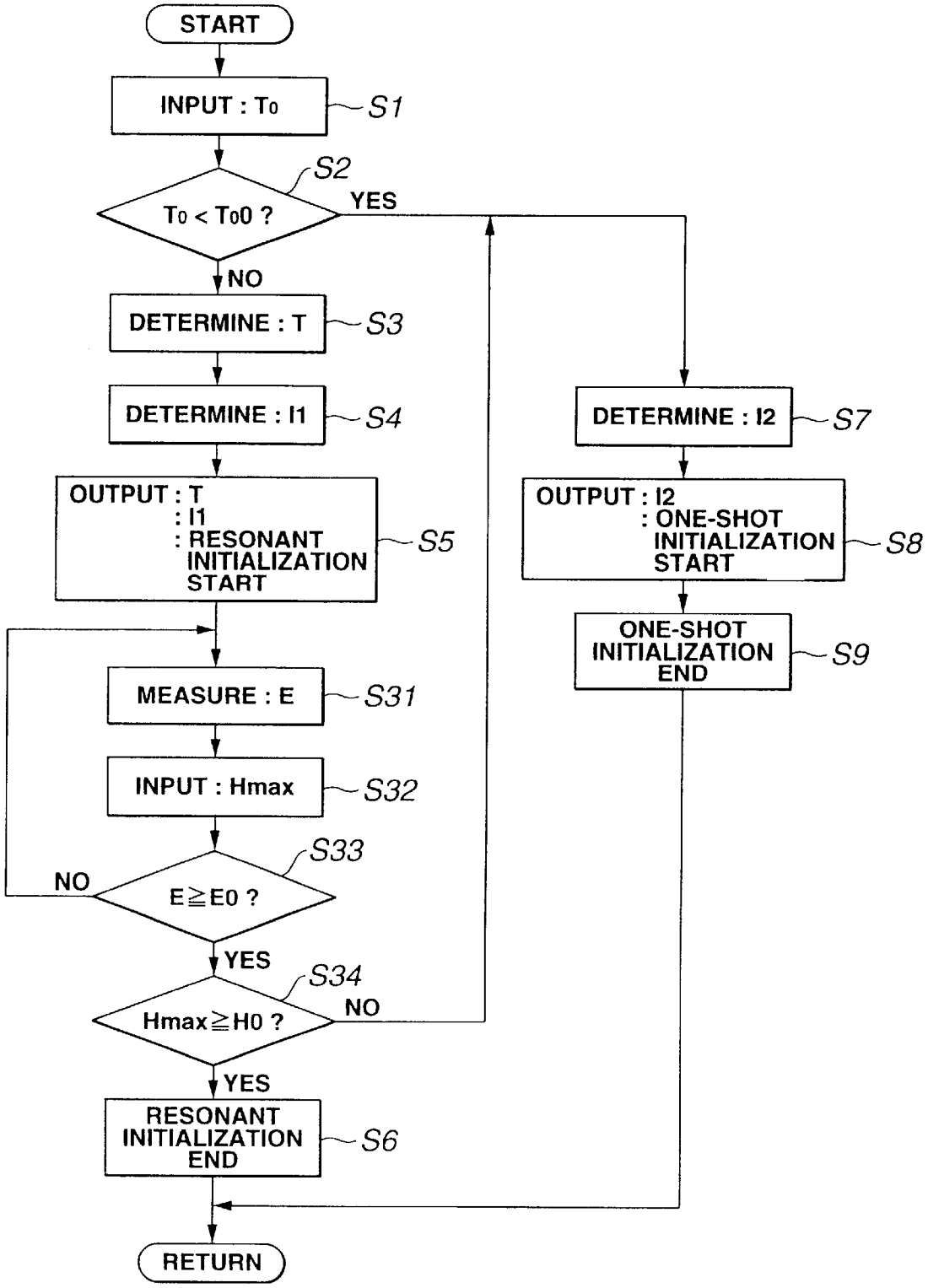
FIG. 11 is a flow diagram for implementing the fourth embodiment of the present invention.

Referring to FIG. 11, a flow of the initialization control implemented in the fourth embodiment will be explained hereinafter.

As illustrated in FIG. 11, the sequence of operations executed at blocks S1–S5 is the same as that in the first embodiment shown in FIG. 5. Subsequent to block S5, the logic flow goes to blocks S31 and S32. At block S31, an elapsed time E from the start of the resonant initialization is measured. At block S32, an amount of displacement of armature 42 detected by lift sensor 21 is continuously inputted from the start of the resonant initialization and updated and a maximum amount Hmax thereof detected is stored. The logic flow goes to decision block 33 at which an interrogation is made whether or not the measured time E is not less than the predetermined time E0. If the interrogation at decision block S33 is in affirmative, the logic flow goes to decision block S34. At decision block 34, an interrogation is made whether or not the maximum amount Hmax stored is not less than the predetermined value H0. If the interrogation at decision block S34 is in affirmative, the logic flow goes to block S6 at which the resonant initialization is terminated. If the interrogation at decision block S34 is in negative, indicating that the maximum amount Hmax stored is smaller than the predetermined value H0 as indicated by curve 400 in FIG. 6, it is decided to make a changeover from the resonant initialization to the one-shot initialization and the logic flow goes to blocks S7–S9. At blocks S7–S9, the sequence of operations of the one-shot initialization is conducted, similar to the first embodiment.

If the interrogation at decision block S33 is in negative, indicating that the predetermined time E0 does not elapse, the logic flow goes back to block S31 and the measurement of the elapsed time E is repeated.

In order to assure the completion of the one-shot initialization shifted from the resonant initialization, a control current for energizing one of the electromagnets in the one-shot initialization may be a maximum current value regardless the determined viscosity of the engine lubricating oil. Further, the predetermined time E0 may be set to a value at which an amplitude of the oscillation of armature 42 reaches substantially an extreme value. In such a case, the updating and storing of the detected maximum amount Hmax of displacement of armature 42 at block S32 can be omitted and the displacement amount thereof inputted at a moment the predetermined time E0 elapsed can be immediately compared with the predetermined value H0 at block S34.

In this embodiment, even in a case where the engine valve fails to be placed in one of the closed and full open positions during the predetermined period after the resonant initialization starts, the engine valve can be placed in the one of the closed and full open positions by the one-shot initialization shifted from the resonant initialization. Thus, in the fourth embodiment, the initialization of the engine valve can be completed by shifting from the resonant initialization to the one-shot initialization even if the resonant initialization is not normally executed after the commencement.

Figure 12:
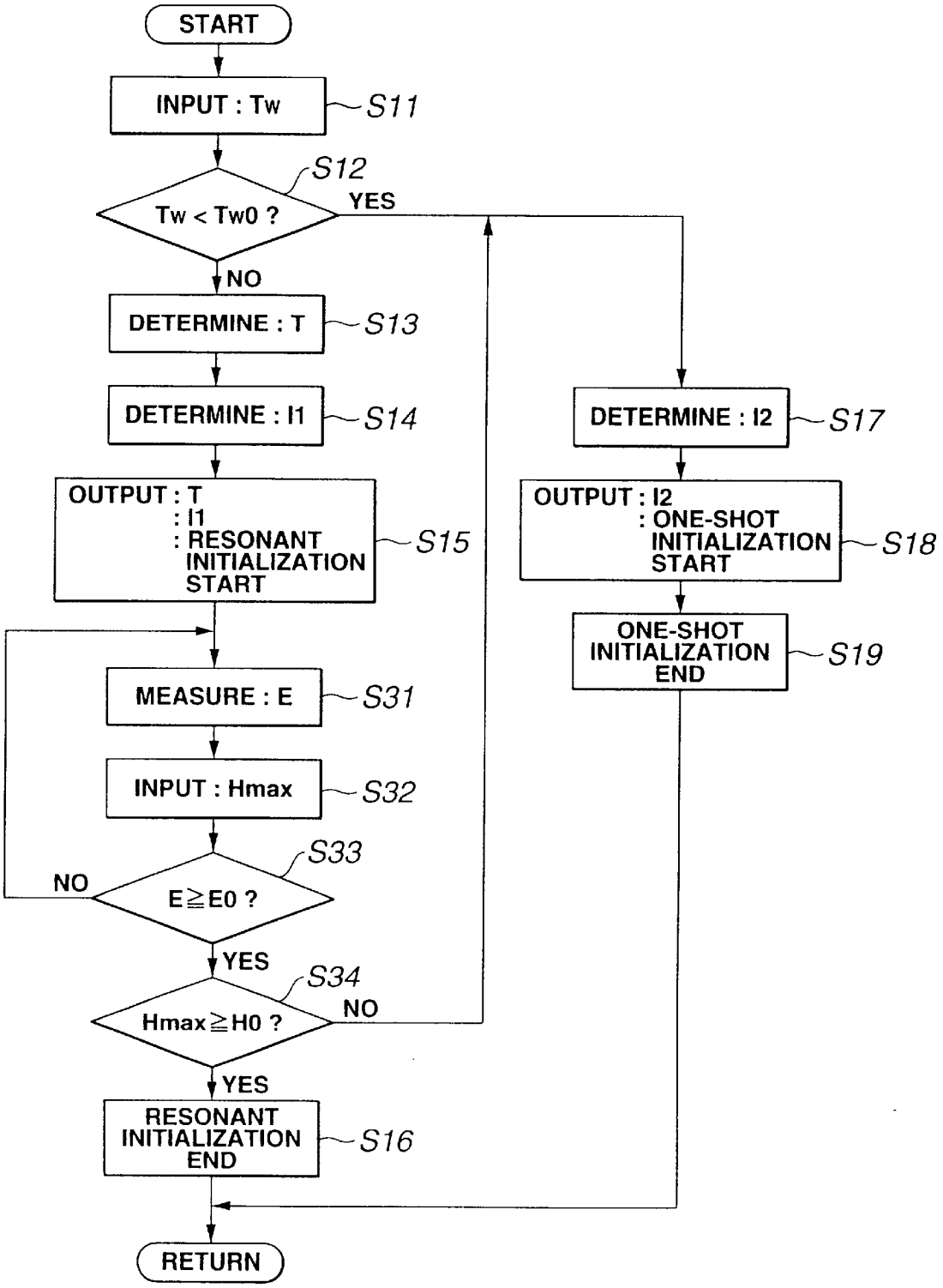
FIG. 12 is a flow diagram for implementing the fifth embodiment of the present invention.

Referring to FIG. 12, a flow of the initialization control implemented in the fifth embodiment is explained. The fifth embodiment differs from the fourth embodiment in that the viscosity of the engine lubricating oil is determined depending on the detected temperature Tw of the engine coolant.

Figure 13:
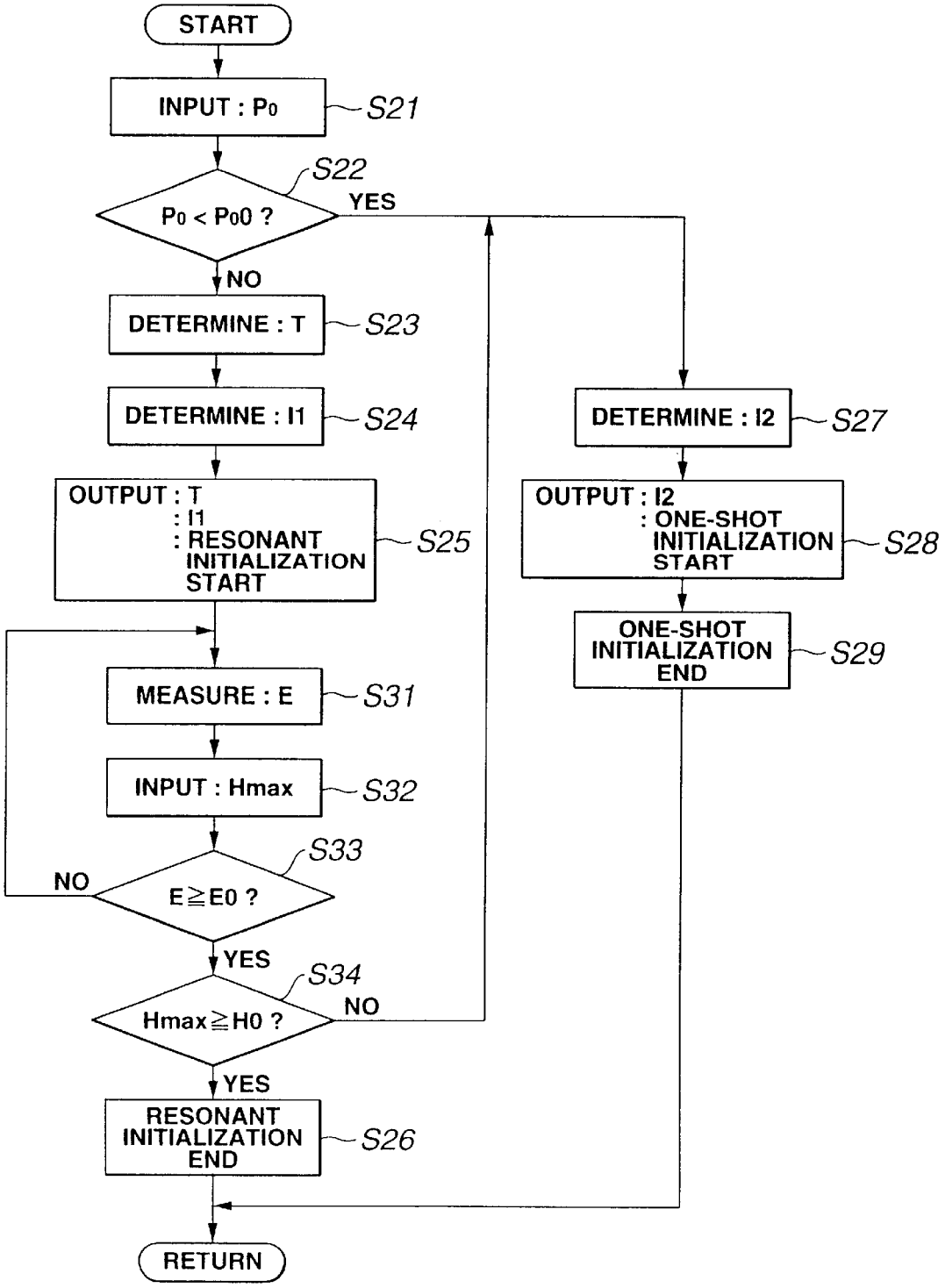
FIG. 13 is a flow diagram for implementing the sixth embodiment of the present invention.

Referring to FIG. 13, a flow of the initialization control implemented in the sixth embodiment is explained. The sixth embodiment differs from the fourth embodiment in that the viscosity of the engine lubricating oil is determined depending on the detected pressure Po of the engine lubricating oil.

In the fifth and sixth embodiments, the predetermined time E0 may be set to the value at which an amplitude of the oscillation of armature 42 becomes substantially the extreme value. The updating and storing of the detected maximum amount Hmax of the armature displacement at block S32 may be omitted and the armature displacement amount inputted at the moment the predetermined time E0 elapsed may be immediately compared with the predetermined value H0 at block S34. The fifth and sixth embodiments also can exhibit same effects as those of the fourth embodiment.

This application is based on Japanese Patent Application No. 11-226147, filed on Aug. 10, 1999, the entire contents of which, inclusive of the specification, claims and drawings, are hereby incorporated by reference herein.

Although the invention has been described above by reference to certain embodiments of the invention, the invention is not limited to the embodiments described above. Modifications and variations of the embodiment described above will occur to those skilled in the art, in light of the above teachings. The scope of the invention is defined with reference to the following claims.

What is claimed is:

1. An apparatus for controlling an engine valve operated by an electromagnetic actuator, the engine valve having a closed position and a full open position, the electromagnetic actuator including springs cooperating to bias the engine valve toward a mid-open position between the closed and full open positions and two electromagnets attracting and moving the engine valve in the closed and full open positions against spring forces of the springs upon being energized, respectively, the apparatus comprising:

sensor means for sensing a parameter to be used in determining a viscosity of an engine lubricating oil; and a controller programmed to determine the viscosity of an engine lubricating oil on the basis of the parameter sensed and execute either one of a resonant initialization preceding an engine startup, in which the engine valve is oscillated with an increasing amplitude to be moved from the mid-open position to one of the closed and full open positions and held therein by alternate energization of the electromagnets, and a one-shot initialization preceding the engine startup, in which the engine valve is moved from the mid-open position to one of the closed and full open positions and held therein with one stroke by onetime energization of one of the electromagnets, depending on the determined viscosity of an engine lubricating oil.

2. An apparatus as claimed in claim 1, wherein the controller is programmed to execute the resonant initialization when the determined viscosity of an engine lubricating oil is lower than a predetermined value and selects the one-shot initialization when the determined viscosity of an engine lubricating oil is not less than the predetermined value.

3. An apparatus as claimed in claim 1, wherein the sensor means senses a temperature of the engine lubricating oil.

4. An apparatus as claimed in claim 1, wherein the sensor means senses a temperature of an engine coolant.

5. An apparatus as claimed in claim 1, wherein the sensor means senses a pressure of the engine lubricating oil.

6. An apparatus as claimed in claim 1, wherein the controller is programmed to determine a predetermined period of energization of each electromagnet upon the resonant initialization.

7. An apparatus as claimed in claim 1, wherein the controller is programmed to determine a predetermined value of a current supplied to each electromagnet upon the resonant initialization.

8. An apparatus as claimed in claim 1, wherein the controller is programmed to determine a predetermined value of a current supplied to the one of the electromagnets upon the one-shot initialization.

9. An apparatus as claimed in claim 1, further comprising sensor means for sensing a maximum lift amount of the engine valve.

10. An apparatus as claimed in claim 9, wherein the controller is programmed to make a changeover from the resonant initialization to the one-shot initialization when a predetermined time elapses from start of the resonant initialization and the detected maximum lift amount of the engine valve is less than a predetermined value.

11. An apparatus as claimed in claim 1, wherein the controller is programmed to terminate the resonant initialization when the number of alternate energization of the electromagnets reaches a predetermined value.

12. An apparatus as claimed in claim 1, wherein the controller is programmed to terminate the resonant initialization when a predetermined time elapses from start of the resonant initialization.

13. An apparatus as claimed in claim 1, wherein the controller is programmed to terminate the one-shot initialization when a predetermined time elapses from start of the one-shot initialization.

14. An apparatus as claimed in claim 1, further comprising sensor means for sensing a lift amount of the engine valve.

15. An apparatus as claimed in claim 14, wherein the controller is programmed to terminate the one-shot initialization when the sensed lift amount of the engine valve reaches a predetermined value.

16. An apparatus for controlling an engine valve operated by an electromagnetic actuator, the engine valve having a closed position and a full open position, the electromagnetic actuator including springs cooperating to bias the'engine valve toward a mid-open position between the closed and full open positions and two electromagnets attracting and moving the engine valve in the closed and full open positions against spring forces of the springs upon being energized, respectively, the apparatus comprising:

a sensor detecting a parameter to be used in determining a viscosity of an engine lubricating oil and generating a signal indicative of the parameter detected; and a controller, in response to the signal generated from the sensor, determining the viscosity of an engine lubricating oil, the controller selecting either one of a resonant initialization preceding an engine startup, in which the engine valve is oscillated with an increasing amplitude to be moved from the mid-open position to one of the closed and full open positions and held therein, and a one-shot initialization preceding the engine startup, in which the engine valve is moved from the mid-open position to one of the closed and full open positions and held therein with one stroke, depending on the determined viscosity of the engine lubricating oil, and the controller developing a first control command for alternately energizing the electromagnets for the resonant initialization and a second control command for one-time energizing one of the electromagnets for the one-shot initialization.

17. An apparatus as claimed in claim 16, wherein the controller develops the first control command when the determined viscosity of an engine lubricating oil is lower than a predetermined value and develops the second control command when the determined viscosity of an engine lubricating oil is not less than the predetermined value.

18. An apparatus as claimed in claim 16, wherein the sensor includes an oil temperature sensor detecting a temperature of the engine lubricating oil and generating a signal indicative of the detected temperature.

19. An apparatus as claimed in claim 16, wherein the sensor includes a coolant temperature sensor detecting a temperature of an engine coolant and generating a signal indicative of the detected temperature.

20. An apparatus as claimed in claim 16, wherein the sensor includes an oil pressure sensor detecting a pressure of the engine lubricating oil and generating a signal indicative of the detected pressure.

21. An apparatus as claimed in claim 16, wherein the controller determines a predetermined period of energization of each electromagnet upon the resonant initialization.

22. An apparatus as claimed in claim 16, wherein the controller determines a predetermined value of a current supplied to each electromagnet upon the resonant initialization.

23. An apparatus as claimed in claim 16, wherein the controller determines a predetermined value of a current supplied to the one of the electromagnets upon the one-shot initialization.

24. An apparatus as claimed in claim 16, further comprising a lift sensor detecting a maximum lift amount of the engine valve and generating a signal indicative of the detected maximum lift amount.

25. An apparatus as claimed in claim 24, wherein the controller makes a changeover from the resonant initialization to the one-shot initialization when a predetermined time elapses from start of the resonant initialization and the detected maximum lift amount of the engine valve is less than a predetermined value.

26. An apparatus as claimed in claim 16, wherein the controller terminates the resonant initialization when the number of alternate energization of the electromagnets reaches a predetermined value.

27. An apparatus as claimed in claim 16, wherein the& controller terminates the resonant initialization when a predetermined time elapses from start of the resonant initialization.

28. An apparatus as claimed in claim 16, wherein the controller terminates the one-shot initialization when a predetermined time elapses from start of the one-shot initialization.

29. An apparatus as claimed in claim 16, further comprising a lift sensor detecting a lift amount of the engine valve and generating a signal indicative of the detected lift amount.

30. An apparatus as claimed in claim 29, wherein the controller terminates the one-shot initialization when the detected lift amount of the engine valve reaches a predetermined value.

31. A method of controlling an engine valve operated by an electromagnetic actuator, the engine valve having a closed position and a full open position, the electromagnetic actuator including springs cooperating to bias the engine valve toward a mid-open position between the closed and full open positions and two electromagnets attracting and moving the engine valve in the closed and full open positions against spring forces of the springs upon being energized, respectively, the method comprising:

determining a viscosity of an engine lubricating oil;

selecting either one of a resonant initialization preceding an engine startup, in which the engine valve is oscillated with an increasing amplitude to be moved from the mid-open position to one of the closed and full open positions and held therein by alternately energizing the electromagnets, and a one-shot initialization preceding the engine startup, in which the engine valve is moved from the mid-open position to one of the closed and full open positions and held therein with one stroke by onetime energizing one of the electromagnets, depending on the determined viscosity of an engine lubricating oil; and executing the selected one of the resonant initialization and the one-shot initialization.

32. A method as claimed in claim 31, wherein the selecting includes selecting the resonant initialization when the determined viscosity of an engine lubricating oil is lower than a predetermined value and selecting the one-shot initialization when the determined viscosity of an engine lubricating oil is not less than the predetermined value.

33. A method as claimed in claim 31, further comprising detecting a parameter to be used in the determination of a viscosity of an engine lubricating oil.

34. A method as claimed in claim 33, wherein the selecting includes comparing the parameter with a predetermined value.

35. A method as claimed in claim 33, wherein the parameter is a temperature of the engine lubricating oil.

36. A method as claimed in claim 33, wherein the parameter is a temperature of an engine coolant.

37. A method as claimed in claim 33, wherein the parameter is a pressure of the engine lubricating oil.

38. A method as claimed in claim 31, wherein the executing the selected resonant initialization includes determining a predetermined period of energization of each electromagnet.

39. A method as claimed in claim 31, wherein the executing the selected resonant initialization includes determining a predetermined value of a current supplied to each electromagnet.

40. A method as claimed in claim 31, wherein the executing the selected one-shot initialization includes determining a predetermined value of a current supplied to the one of the electromagnets.

41. A method as claimed in claim 31, further comprising detecting a maximum lift amount of the engine valve.

42. A method as claimed in claim 41, further comprising making a changeover from the resonant initialization to the one-shot initialization when a predetermined time elapses from start of the resonant initialization and the detected maximum lift amount of the engine valve is less than a predetermined value.

43. A method as claimed in claim 31, wherein the executing the selected resonant initialization includes terminating the resonant initialization when the number of alternate energization of the electromagnets reaches a predetermined value.

44. A method as claimed in claim 31, wherein the executing the selected resonant initialization includes terminating the resonant initialization when a predetermined time elapses from start of the resonant initialization.

45. A method as claimed in claim 31, wherein the executing the selected one-shot initialization includes terminating the one-shot initialization when a predetermined time elapses from start of the one-shot initialization.

46. A method as claimed in claim 31, further comprising detecting a lift amount of the engine valve.

47. A method as claimed in claim 46, wherein the executing the selected one-shot initialization includes terminating the one-shot initialization when the detected lift amount of the engine valve reaches a predetermined value.

* * * * *